219-121
7/4/78 XR 4,098,448 SR

United States Patent [19]
Sciaky et al.
[11] 4,098,448
[45] Jul. 4, 1978

[54] METHOD AND APPARATUS FOR MANUFACTURING ROTARY DRILL BITS

[75] Inventors: Albert M. Sciaky, Palos Park; William R. Mello, Lockport, both of Ill.

[73] Assignee: Sciaky Bros., Inc., Chicago, Ill.

[21] Appl. No.: 727,162

[22] Filed: Sep. 27, 1976

[51] Int. Cl.[2] ..... B23K 15/00; B23K 37/04
[52] U.S. Cl. ..... 228/102; 228/103; 228/182; 228/212; 228/44.1 R; 76/108 A; 219/121 EB; 219/121 EM
[58] Field of Search ..... 228/44.1 R, 182, 212, 228/196, 102–104; 76/108 A; 175/375; 219/121 EB, 121 EM

[56] References Cited

U.S. PATENT DOCUMENTS

| | | | |
|---|---|---|---|
| 3,907,191 | 9/1975 | Lichte | 228/182 |
| 3,958,739 | 5/1976 | Wicker et al. | 228/44.1 R |
| 3,987,859 | 10/1976 | Lichte | 175/375 |

*Primary Examiner*—Donald G. Kelly
*Assistant Examiner*—K. J. Ramsey
*Attorney, Agent, or Firm*—Julius L. Solomon

[57] ABSTRACT

A method and apparatus for the manufacture of rotary drill bits such as are used for oil well drilling which are constructed from a multiplicity of segments. The segments are provided with registration means for positioning the segments relative to one another and are placed in a fixture where they are sized to a desired outer diameter without sliding the faces of the segment one against the other during the sizing operation. The faces are then brought into abutment, clamped and welded along the abutting surfaces between segments.

13 Claims, 7 Drawing Figures

35
42

43
44
42
45
45
46
39
40
37
38
41
35
47
48
53
20
41
41

METHOD AND APPARATUS FOR MANUFACTURING ROTARY DRILL BITS

This invention relates to a method and apparatus for manufacturing rotary drill bits and more specifically to a method and apparatus for the proper alignment, sizing and support during welding of the several segments which comprise a drill bit of the type normally used for deep well drilling of oil wells. U.S. Pat. No. 3,907,191 is directed to one method of constructing a rotary rock bit in which the method claimed consists in placing the individual segments adjacent one another with the surfaces of the parting faces of adjacent segments in abutting relationship to one another, sliding the individual segments relative to one another to cause unrestricted movement of the parting faces of an individual segment against the parting faces of the next adjacent segments until the cutting surfaces which move outwardly during the sliding motion come in contact with a gauging ring which determines the outer cutting diameter of the drill bit and therefore the size hole which will be drilled. The parts are held in this position and the segments welded together. In an effort to practice the above method, it was found that the claimed steps could not be followed. When attempting to slide the individual segments relative to one another, as per the second step above, it was found that the friction between the abutting faces prevented the segments from sliding relative to one another and it was necessary at times to interject a step of hammering the segments to overcome the friction between the parting faces in order to bring the cutters in contact with the inner surface of the gauging and sizing ring. Furthermore, after the parts were clamped elaborate methods were required, utilizing a multiplicity of closed circuit television systems, for aligning the plane between the abutting surfaces between the three segments to the fixed plane that the electron beam defined during its motion during the welding operation. Another inconvenience of the old method was that repeatability in bit location was very poor because of the high friction between the abutting faces. Another inconvenience with the old method was that during the sliding and skewing operation, inherent in the old method, the center line or axis of the drill bit is tilted and the plane upon which the surfaces to be welded lie are tilted from the vertical making it necessary to tilt the fixturing device in the opposite direction so that the surfaces are brought to lie in the vertical plane of the electron beam travel, this all resulted in a very complicated and time-consuming set up and therefore costly procedure.

It is the object of the present invention to provide a method for the manufacture of drill bits by which the sizing and clamping the drill bits is accomplished without frictional lockup of the parts and in which the accuracy of bit location is repeatable.

An ancillary object is a simplification of the machining required on the bits and the consequent reduction in manufacturing costs.

A further object is to provide a fixture and method by which the geometric axis of the drill bit is maintained perpendicular to the base of the fixture so that an alignment by means of tilting is not necessary.

A further object is to provide a method by which the plane of the weld is easily established automatically and accurately without the necessity of operator skill. In this method only two points in addition to a built in registration point on the fixture are required in order to determine the plane in which the surfaces to be welded lie.

A further object is to provide a clamping and sizing device which does not require the operator to hammer the parts during the sizing operation.

Another object of the invention is to provide a method whereby the segments of the drill bit may be aligned without the use of a multiplicity of closed circuit television systems to establish the three points which define the weld plane in the old method of alignment.

Another object is to provide a method whereby the offset error between the plane of the abutting faces of the tool bit and the plane of the electron beam is reduced to an extremely low value.

An ancillary object of the invention is to permit stronger welds than have heretofore been possible by the old method.

The present invention is designed for the manufacture of rotary earth boring drills or bits of the type illustrated in Patent No. U.S. Pat. No. 2,807,444 or U.S. Pat. No. 2,831,661. These bits are constructed of asymetric arcuate segments which support the rolling cutters. The segments are inserted in the fixture of the invention and automatically sized so that the outer periphery of the cutters will, during the drilling operation, cut a hole of the intended size. In prior methods of assembling the three segments in a fixture or jig for supporting the parts during the welding operation, cylindrical depressions have been machined in the mating surfaces of the segments, into which dowel pins have been loosely placed. The segments have been skewed by sliding one surface against the next with the segments moving about the pins acting as pivots. This allowed for sizing of the drill bit cutter to a gauge ring prior to clamping the segments in preparation for welding and registered the segments one with respect to the other at the dowel positions. In the present invention, a cylindrical hollow is provided at the bottom of the leg of the segment for registration of the three segments in the fixture in order that the lower part of the segments may be assembled so that they bear a predetermined relationship to one another. The fixture is designed so that the segments after they are registered over the dowel pins in the base of the fixture fall by gravity so that a point on the outer periphery of each rotatable cutter leans against the inner surface of the sizing ring so that the cutters are thus first sized to the I.D. of a gauge ring which is supported within close tolerances on the fixture at the level of the cutters. The faces between adjoining segments are at this time widely separated with the cutters remaining in engagement with the gauging ring. Each segment is then simultaneously caused to rotate about the vertical axis of the registration pin which is engaged in the cylindrical cavity machined into one end of the bottom of the leg of each segment. The end of each segment leg will describe an arc in a horizontal plane and the adjacent surfaces of the segments will move towards each other while the cutters remain always in contact with the sizing ring. During this step of the method there is no appreciable friction between the parts inasmuch as the faces are not in abutment with one another. The segments move towards one another smoothly along a curved path and finally the faces come into abutment one to the next at which point the clamping operation is completed, the cutters having been sized from the beginning. There is no sliding of one surface of the segment against the surface of another segment and there is no need for the use of a hammer to overcome any frictional effect. Note that the parts are restricted by register pins at the bottom of each segment leg and by a sizing ring in the cutter plane at the top of the assembled segments with resilient clamping means used in between. This results in the cutter being properly sized to the desired cutting diameter and the assembly centered about the vertical axis of the fixture. The parts after clamping are then moved into the welding chamber where the seam is scanned by the electron beam in the manner described in the seam finder U.S. Pat. No. 3,609,288 and its absolute position with respect to the electron beam impact point determined and this information placed in computer memory to be used in the control of the motion of the electron gun. It is only necessary to scan two points along the seam, one at the top, one in the center, the third point in the plane being already fixed thanks to the use of registration pins. The three points not being on a straight line will define the plane which the beam is to describe during its travel while welding the parts. In the old fixturing method it was necessary to utilize a station outside the vacuum chamber at which station the parts were assembled, clamped and sized in accordance with the old steps of U.S. Pat. No. 3,907,191 and a second station at which the clamped assembly was checked by the use of three separate closed circuit television cameras and monitors. The monitors were each provided with a reference marker which defined the position of the plane in which the electron beam would travel during the welding process. Because the three segments could be clamped and sized with the segments oriented in different ways with respect to one another it was found that the longitudinal geometric axis of the clamped assembly of segments often did not coincide with the rotational axis of the fixture. Since the sizing ring floats and is not fixed in relation to the frame of the fixture and since the foot of each segment is not restricted in the radial direction the bottom portion of the segment assembly and the top cutter portion are not necessarily concentric with the rotational axis of the fixture after clamping. As a consequence the fixed 120° rotation of the fixture did not bring all of the planes to be welded in coincidence with the plane of the beam. Furthermore, because of the skewing of the segments during sizing, the planes between the faces to be welded are tilted so that the geometric axis of the assembly does not lie on these planes. Because the machine is constructed to have a vertical gun motion it is necessary to provide a tilt adjustment on the fixture so as to bring the planes between the faces to be welded in coincidence with the vertical plane determined by the motion of the beam. It is therefore necessary to use the verification station to check whether the planes of the segment faces will coincide with the plane defined by the electron beam during its motion while welding. If it is found that the planes do not coincide it is necessary for the operator to loosen the clamps, adjust the parts and try for a new position of the segments in relation to one another. By means of this trial and error procedure and the use of a hammer the operator may finally be able to verify that the parts are properly positioned for welding. The parts are then brought into the vacuum chamber and welded by the electron beam.

The present invention does not require this trial and error method. In fact there is no need at all for a verification station. The parts are simply clamped into the proper position automatically and the fixture moved into the vacuum chamber where the parts are welded under full control of a computer. All this due to the novel sizing and clamping method of the present invention.

There is yet another advantage in the new method since the elaborate and time consuming process of adjusting the verification cameras when the machine is changed over for different size drill bits when using the old method is not required in the method of the present invention. The method of operation and the advantages and utility of the present invention will become more fully apparent from the following descriptions considered in connection with the accompanying drawings in which.

Figure 1:
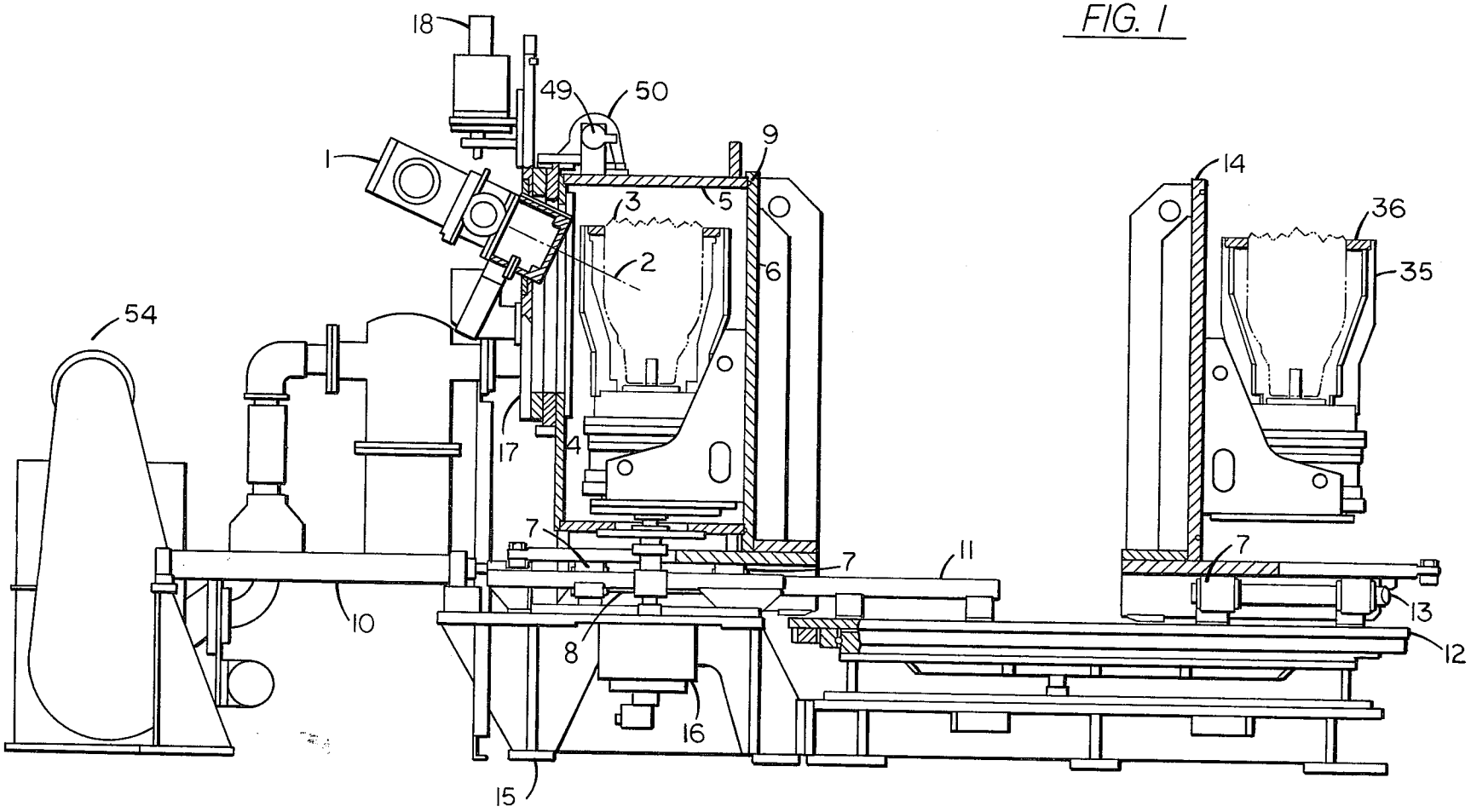
FIG. 1 is a side view of an electron beam welding machine for the welding of drill bits.

FIG. 1 is a drawing showing the general assembly of an electron beam welding machine and associated handling and fixturing equipment for the welding of drill bits. The electron beam gun 1 in which an electron beam is generated directs the electron beam 2 so that the electron beam strikes the work 3 along the abutting edges between the segments which are clamped on the fixture 4. The fixture 4 is fixed to door 6 of the vacuum chamber 5. The door 6 assembly is supported by bearings 7 which are arranged to slide along cylindrical rails 8 and when moved to the left will carry the parts mounted on the fixture into the vacuum chamber. The chamber is made airtight by means of the continuous seal 9 mounted on the door which seals to the open edges of the chamber. In order to bring the fixturing parts out of the chamber, the door assembly is moved to the right by means of pneumatic or hydraulic operator 10. The door assembly at the end of its travel to the right will be supported by guide rails 11 to which it has been transferred from guide rails 8 during the motion towards the right. Rails 11 are mounted on the rotary two position turntable 12 upon which is mounted diametrically opposite to rails 11, the rails 13 which are shown supporting a second vacuum chamber door 14 carrying a second fixture. This second position is utilized for loading and unloading the parts onto the fixture while the door 6 is in position during the welding operation within the vacuum chamber. The rails 8 are mounted on chamber base 15 upon which the vacuum chamber 5 is mounted. A servo motor 16 is fitted to the chamber base and by means of suitable feed through vacuum sealed shafts and a speed reducer is arranged to rotate the fixture in order to position the parts successively to a fixed reference angle for each seam to be welded. The gun is arranged to move in the horizontal and vertical directions by means of sliding seal arrangement 17 to which it is fixed driven by servo motors 50 and 18 respectively through suitable rotary to linear translation devices such as the ball screw cross slide 49.

Motors 50 and 18 may be controlled automatically to cause the electron beam to follow the desired seam from information which has previously been stored in a computer, for example, which may be also arranged to control the welding parameters such beam current, beam voltage, focus current and welding speed and automate all other functions of the machine.

After a drill bit has been welded and the door assembly moved to the right so that the door assembly is in place on rails 11 the turntable is rotated 180° so that door 14 is brought to the vacuum chamber and door 6 takes the position previously held by door 14. Door 14 is slid to the left so that the fixture and the parts which have been assembled at the loading station are moved into the chamber. The chamber is sealed and pumped down by means of the vacuum pump system 54. When a suitable pressure, approximately 50 microns, is achieved within the vacuum chamber, the welding process under the control of the computer takes place. The position of each of the three seams to be welded with respect to a reference is determined at two points along each seam by scanning the seams at these two points with the electron beam and placing the position information in computer memory. One of these points is at the bottom of the seam and is found by holding the beam fixed toward the center and rotating the fixture. Inasmuch as the plane of the seam is on a diameter at the bottom and since the scanning seam is directed radially, a line which lies in the plane of the joint is determined. The second point near the top of the seam is found by scanning the seam at this level while moving the gun horizontally by means of the motor 50 driving cross slide ball screw 49 while maintaining the angular position of the fixture found in determining the first point.

The welding program will then be initiated under control of the computer, the first seam welded in accordance with a predetermined weld schedule the beam turned off and the gun rotated to the second seam to be welded, the second seam welded and the part moved to the third seam and welded. During this welding period, the parts which have previously been welded are removed at the load and unload position of the turntable and a new set of three segments is positioned, sized and clamped on the fixture in preparation for welding.

Figure 2:
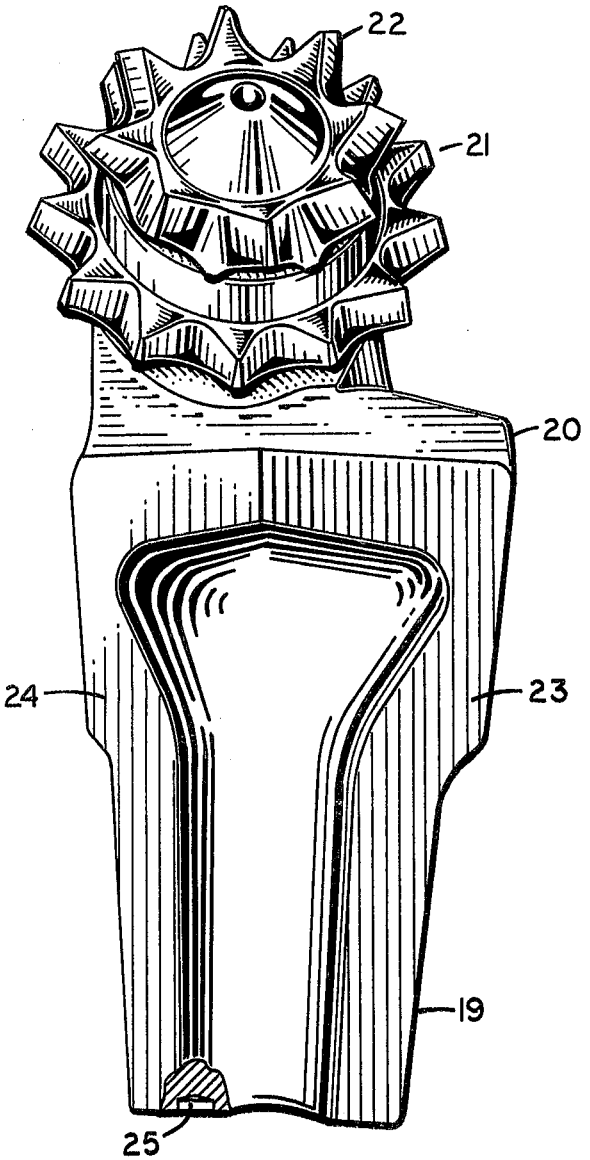
FIG. 2 illustrates one of the segments of a typical drill bit adapted for use with the fixture of the present invention.
Figure 7:
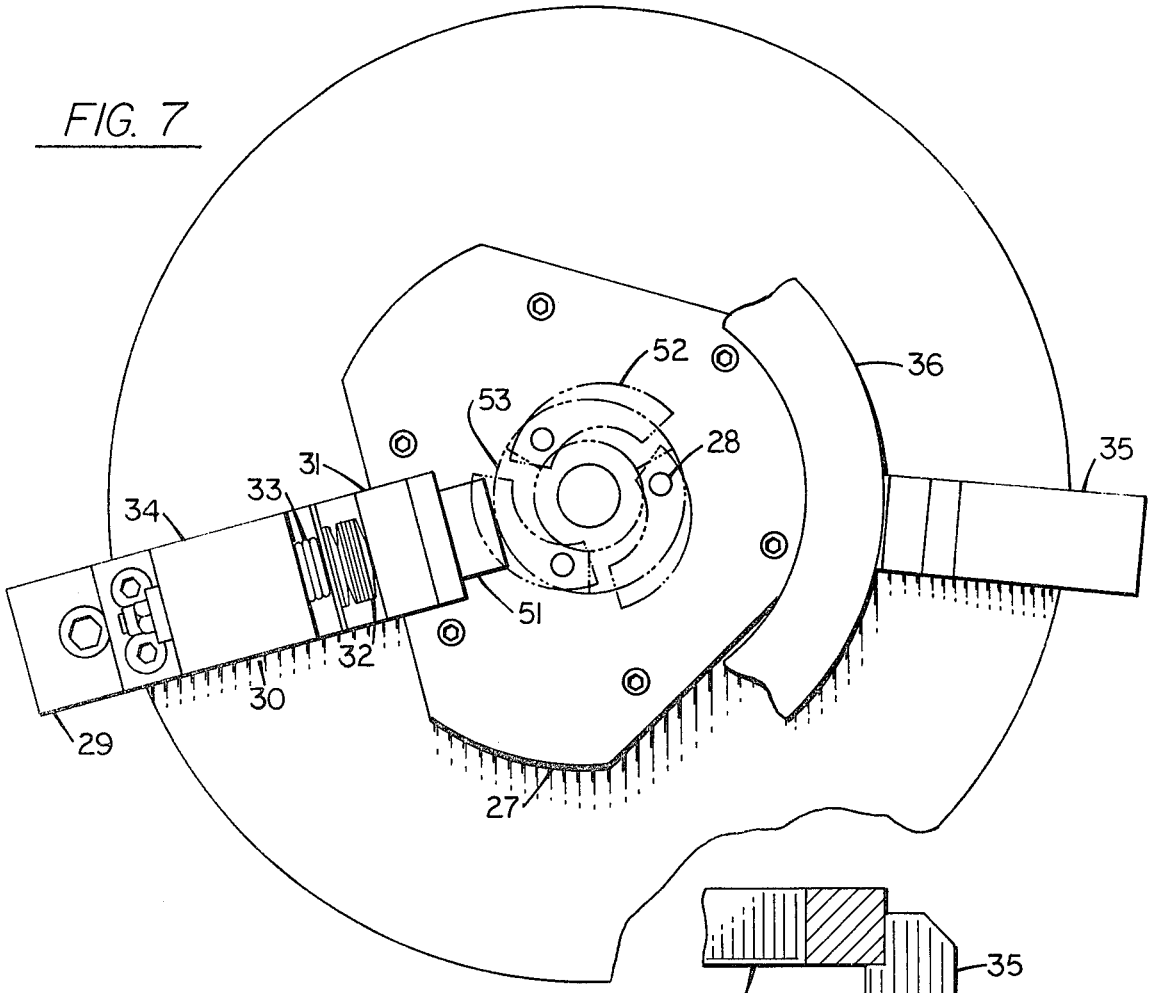
FIG. 7 is a top view of the tooling used to locate size and clamp the segments prior to welding.

FIG. 2 illustrates a typical segment from which the drill bit is constructed. Each segment is forged, to the approximate shape shown, of a suitable alloy steel; for example, AISI 8620, which contains .20 carbon, .80 manganese MN, .035 phospor P, .040 sulfur S maximum, .27 silicon SI, .55 nickel NI, .50 chromium CR, .20 molybdenum MO. The forging for each segment is fashioned with a section 19 which will form the shank of the three segment assembly, the bit leg 20 and what is commonly termed the shirttail 21. Two planes 23 and 24 are machined to provide surfaces at 120° from one another which will be in abutment with like machined surfaces on adjacent segments in the complete assembly of the three segments which form the drill bit and it is these surfaces which are welded together by the electron beam welding process. Each segment is also machined at the inner shirttail area to provide a journal for supporting the cutter 22 and its associated bearings. A short cylindrical recess is machined at the bottom and one end of the shank of each segment. This recess 25 is used to locate the segments properly when they are placed in the fixture prior to sizing and clamping of the drill bit segments in preparation for welding.

Figure 3:
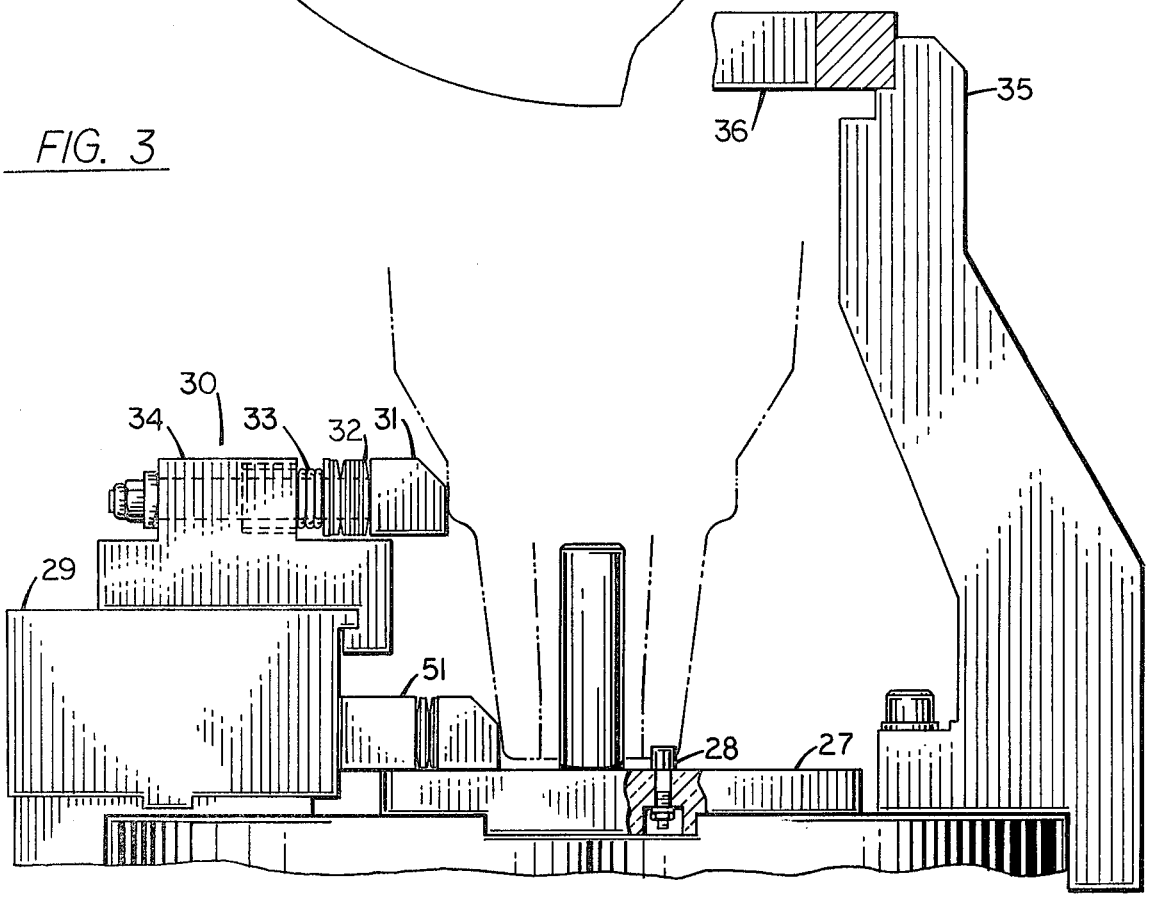
FIG. 3 is a side view and elevation of the tooling used to locate, size and clamp the segments prior to welding.

FIG. 3 is a side view and elevation of the tooling utilized to locate, size, and clamp the parts in preparation for welding. The tooling comprises a three jaw chuck, which has been modified by the addition of special spring jaws 30 which are mounted on the standard soft jaws of the chuck, which is mounted on the fixture which is part of the door assembly. A registration plate 27 is centered and fastened to the chuck. Plate 27 is fitted with three pins 28 which are placed symmetrically about the center at 120° from each other and at a radial distance depending upon the size of the drill bit to be welded. The spring loaded jaws assembly 30 is comprised of a hard surfaced jaw 31 which takes reaction through relatively high rate bellville springs 32 in series with slow rate helical spring 33 against the inner annular recess in body 34 into which the spring 33 is installed.

When using the tooling the following steps are taken in sequence:

1. The segments are installed, each segment located by placing the recess at the bottom of each segment over its registration pin 28 mounted on plate 27, with their adjacent faces separated.
2. The cutters are sized (refer to FIG. 3). A sizing ring 36 is provided which is supported under close tolerance by ring supports 35 three of which are mounted equidistant from each other on the surface of the chuck. When the segments are placed in position over the registration pins, the three segments being top heavy and with their center of gravity outside the circle of the pins, will fall outwardly until the cutters are in contact with the inner surface of the sizing ring 36 and thus will be properly sized to the desired cutter outer diameter. The faces of adjacent segments at this time will be separated and a cross section at the bottom of the assembly of three segments will appear as is shown at 52.
3. The faces are put into abutment. The operator will then turn the key of the chuck causing each of the three hard jaws 31 to apply a radial force to a point on the outer surface of the segments which lies along a radial line approximately 75° from the radial line passing through the registration pin locating each segment. The three segment faces will then be caused to move toward each other. The segments rotating about the registration pin and a point of contact at the upper portion of the adjacent segment faces. While this motion is taking place, the O.D. of the cutter is maintained in contact with the I.D. of the sizing ring 36. During this motion, the force against the segments can be no more than the low spring force of spring 33.
4. The parts are clamped. After the faces come into abutment the operator continues to tighten the chuck until spring 33 becomes solid at which time bellville springs 32 will begin to deflect and the clamping force exerted will be the high force which can be transmitted through bellville springs 32. Holding jaws 51 have been provided to hold the lower portion of the segment faces in abutment and to prevent any further motion of the segments while the clamping jaws 31 are being tightened against the center portion of the segments by the compression of the bellville washer springs 32.

The composite spring structure behind the hard jaws 31 insures proper clamping without the necessity to machine the outer surfaces of the segments.

This is in contrast to the old method of clamping in which solid clamping jaws solidly connected to the soft jaw are utilized against a locally machined surface on the periphery of each segment. In utilizing the present fixture there is no friction between the surfaces, the parts are first sized and then the faces are brought smoothly together without it being necessary to hammer the parts as was necessary in applying the old high friction method.

5. The parts are welded along their abutting faces.

Figures 4, 5, 6:
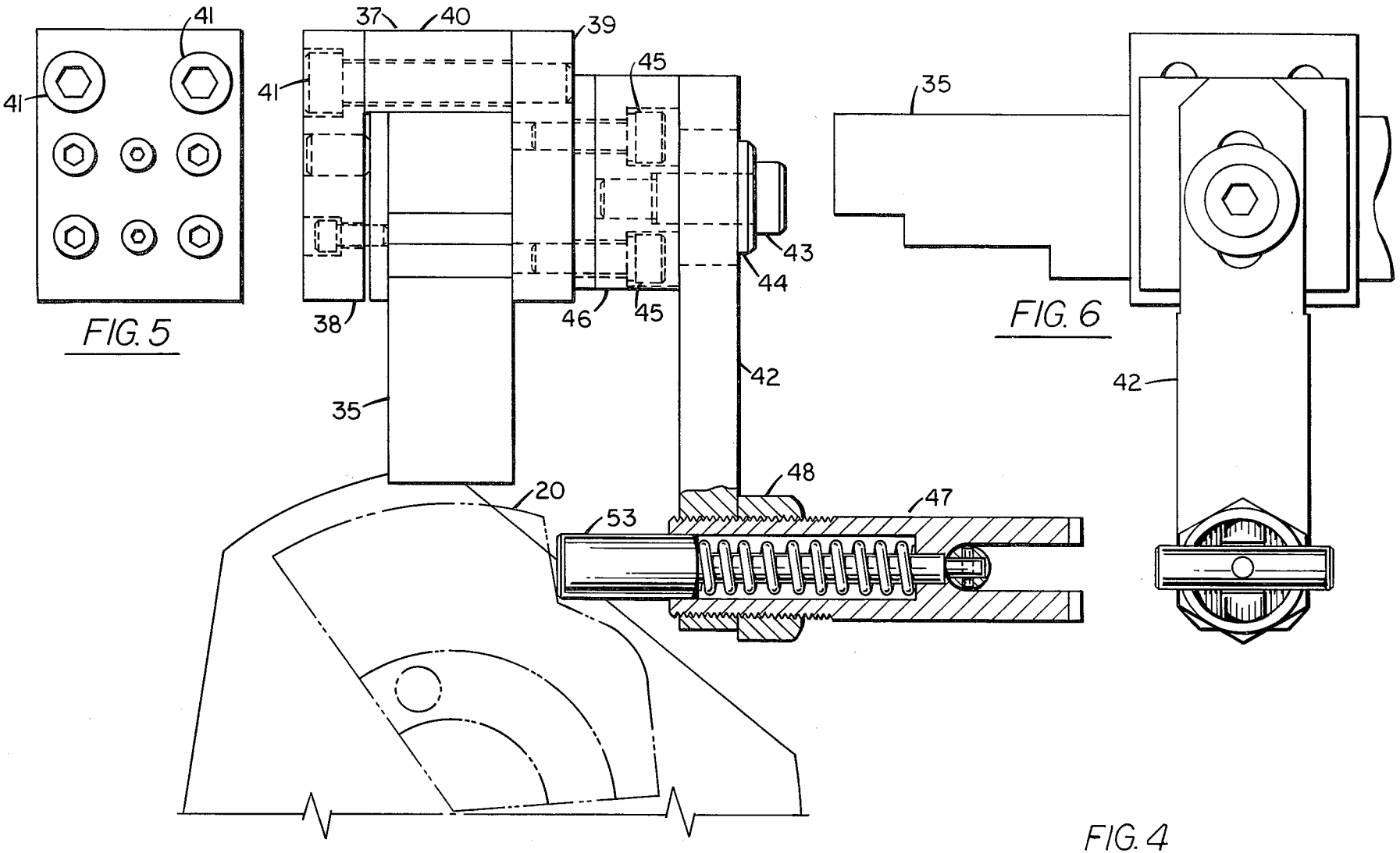
FIG. 4 illustrates a modification of the fixture used to practice the invention.
FIG. 5 is an end view of a portion of FIG. 4 as viewed from the left.
FIG. 6 is an end view of FIG. 4 as viewed from the right.

For certain designs or sizes of tool bits, in which the segments may be balanced over the registration pin so that they do not fall readily under gravity to the sizing ring the device illustrated in FIG. 4 may be added to the ring support 35 so that the segments are urged to move under the action of a tangential force of low magnitude so that the cutters are automatically maintained in the proper position against the inner surface of the sizing ring during the subsequent face closure and clamping steps.

The arrangement illustrated in FIG. 4 comprises a U-shaped structure 37 assembled from three blocks 38,39,40 which are held together by bolts 41. The arm 42 is arranged to rotate about shoulder bolt 8 fastened to mounting block 46 which in turn is fastened to block 39 with bolts 45. A spring plunger 47 is screwed in at one end of the rotatable arm 42 and is provided with a locknut 48 for fastening the spring plunger at a desired position. The rotatable arm normally hangs in the vertical position when the segments are placed upon the fixture over the registration pins. The rotatable arms 42 are lifted to the horizontal position and the nose 53 of the plunger is retracted against the spring, within the housing of the spring plunger, and allowed to bear against the vertical ends of the shirttail portion of the segment. This spring force about 15 pounds urges the shirttail section, which supports the cutters, in the tangential direction and causes the cutters to be held against the sizing ring. The three segments which have been previously placed upon the registration pins are each urged tangentially by the three spring plungers, one acting upon each of the segments, so as to properly size the cutter and maintain it in sized position while the legs of the segments, which will form the shank of the bit, are moved towards each other by the action of the three jaw chuck and the spring loaded jaws attached thereto. After these segments are properly clamped in position, the three spring plungers are released and the arms brought to the vertical position, the turntable rotated 180° from the loading position to the vacuum position, the door and its fixture and the parts moved into the vacuum chamber, the chamber sealed and pumped down to approximately 50 microns and the plane of the surfaces to be welded then defined by determining the position of two points along the seam. This positional information is then relayed to the memory of the computer and used to determine the path the beam is to take in welding each seam and the welding then performed along this path under full control of the computer. Drill bits made in accordance with the above method have been found to be stronger and more accurate in cutter size than bits made by any of the prior known methods.

What I claim is:

1. A method of constructing a drill bit from a multiplicity of like segments comprising the steps of:

machining a cavity into the end of the shank portion of each segment;

placing a multiplicity of said segments into a fixture with adjoining segment faces separated except at one point and so that registration pins mounted upon said fixture lie within the said cavities;

causing rolling cutters mounted upon the bit leg portion of each segment to make contact at a point on each of the said cutters periphery with a sizing gauge ring;

applying a force to each of the segments to cause each segment to rotate about an axis passing through its respective registration cavity so as to bring the faces of adjacent segments in abutment while maintaining the gauged surface of the cutters in contact with the sizing gauge ring;

clamping the segments in fixed relationship to one another;

and, welding the abutting faces between segments.

2. A method in accordance with claim 1 in which the said force is applied to at least one point on each segment.

3. A method in accordance with claim 1 in which the said force is directed toward the vertical geometric axis of the said fixture.

4. A method in accordance with claim 1 in which a tangential force is applied to each segment, after the segments are placed in the fixture, so as to maintain the cutters in contact with the gauge ring.

5. A method in accordance with claim 1 in which the welding is performed by means of the electron beam welding process.

6. A method in accordance with claim 5 which includes the step, after the parts are clamped, of moving the clamped parts into a vacuum chamber;

determining the position of the plane of each of the abutting faces of the clamped segments relative to an electron beam generated by an electron beam gun mounted upon said chamber;

transferring the positional information, defining the position of the plane of each of the abutting faces to be welded, to a computer memory;

and, electron beam welding each of the abutting faces in accordance with said positional information under control of the computer.

7. An apparatus for welding drill bits assembled from a multiplicity of segments each provided with a rotatable cutter comprising:

a vacuum chamber having an opening at one end and provided with a removable door arranged to make the said vacuum chamber airtight;

the said door provided with a rotatable carriage holding a clamping fixture for supporting and clamping the parts to be welded;

a set of pins mounted upon the said fixture for locating and registering the said segments to be welded with respect to each other;

means for sizing the segments to be welded, after they are located on the pins, so that the outer periphery of the drill bit cutters at a desired plane will be sized to a desired dimension;

a multiple jaw chuck for clamping the said segments mounted upon the said fixture, the said chuck provided with a set of soft jaws to which are attached hard surfaced jaws arranged so as to apply a force to the said segments so as to cause each segment to rotate about the vertical axis of its respective locating pin;

means fior supporting the said means for sizing mounted in fixed relation to the said fixture; for a set of springs installed between the hard jaws and the soft jaws;

means for moving the said door away from the said opening of the vacuum chamber so as to allow access to the chamber interior and fixture;

and, means installed on said vacuum chamber for welding the several parts of the drill bit assembly one to another.

8. An apparatus in accordance with claim 7 including means for registering the segments so that a horizontal line along the lower end of the plane of each of the abutting surfaces of the clamped segments passes through the vertical geometric axis of the fixture.

9. An apparatus as in claim 7 having associated with it a turntable having more than one position at which are supported separate chamber doors and fixture assemblies; rails mounted upon said turntable for supporting said doors;

means for causing the said doors to slide upon said rails, at one of said positions;

and, means for driving the said turntable from one position to the next.

10. An apparatus as in claim 9 including means for sliding the said doors into and out of the welding chamber to and from the said turntable.

11. An apparatus as in claim 9 in which the said set of springs comprises a multiplicity of springs in tandem each of said springs having a higher rate of force per unit displacement than the next.

12. An apparatus as in claim 9 including means for applying a substantially tangential force to each segment while the outer diameter of the drill bit cutters is being sized.

13. An apparatus as in claim 12 in which the said means for applying a tangential force are supported by the means for supporting the means for sizing the drill bit cutters.

* * * * *